United States Patent [19]

Gentry et al.

[11] 4,343,243

[45] Aug. 10, 1982

[54] PRINTER FOR IMPRINTING ZIP CODES AND THE LIKE

[75] Inventors: Dorothy I. Gentry, 1344 W. Joan de'Arc, Phoenix, Ariz. 85029; Walter F. Ludwig, Phoenix, Ariz.

[73] Assignee: Dorothy I. Gentry, Phoenix, Ariz.

[21] Appl. No.: 142,117

[22] Filed: Apr. 21, 1980

[51] Int. Cl.[3] ..... B41J 9/00

[52] U.S. Cl. ..... 101/96; 101/100

[58] Field of Search ..... 101/91-92, 101/93.13, 93.18, 100, 111, 107, 288, 287, 336

[56] References Cited

U.S. PATENT DOCUMENTS

| | | | |
|---|---|---|---|
| 2,414,386 | 1/1947 | Olson | 493/420 |
| 3,292,289 | 12/1966 | Fuhr | 40/524 |
| 3,370,531 | 2/1968 | Falk | 101/98 |
| 3,370,532 | 2/1968 | Falk | 101/98 |
| 3,952,649 | 4/1976 | Dikoff | 101/100 |
| 4,075,945 | 2/1978 | Bienholz | 101/111 |
| 4,084,503 | 4/1978 | Pylant | 101/100 |
| 4,246,643 | 1/1981 | Hubbard | 101/91 |

*Primary Examiner*—Edgar S. Burr
*Assistant Examiner*—A. Heinz
*Attorney, Agent, or Firm*—Cahill, Sutton & Thomas

[57] ABSTRACT

A hand-operated printer is disclosed which is suitable for imprinting ZIP codes on letters. The printer includes a printing lever which supports a printing head. Where only the numerals 0-9 need be printed, the printing head includes a printing wheel having raised type numerals thereon and a reading wheel geared to the printing wheel for selecting the numeral to be printed. Where a variety of characters must be printed, for example, the letters of the alphabet, the printing head includes a printing tape having raised type characters thereon and a reading tape geared to the printing tape for selecting the character to be printed. A clamping member is pivotally connected to one end of the printing lever and includes an aperture located opposite the printing head. The clamping member supports an inked ribbon which extends over the aperture. The clamping member is also pivotally connected to a base, and the article to be imprinted is clamped between the base and the clamping member when the printing lever is depressed. The clamping member includes a ratchet mechanism for advancing the inked ribbon each time an article is imprinted. The inked ribbon may carry conventional ink or a special ink (e.g., magnetic, fluorescent, etc.).

9 Claims, 8 Drawing Figures

PRINTER FOR IMPRINTING ZIP CODES AND THE LIKE

BACKGROUND OF THE INVENTION

1. Field of the Invention

The present invention relates generally to hand-operated printing devices and, more particularly, to a hand-operated printer which may be conveniently used to print machine-readable ZIP code information on letters and parcels prior to mailing.

2. Description of the Prior Art

The volume of mail now being processed by postal services in the United States and other countries creates significant delays in the delivery of mail, often resulting in considerable inconvenience. In order to speed the delivery of mail and reduce associated costs of processing mail, many postal systems are turning to automated sorting equipment. Applications of such automated sorting equipment are described in "Mail-Sorting System Reads Typed Addresses and Verifies ZIP Codes", *Electronics*, Dec. 21, 1978, pages 60–61. In one such system, typed mailing addresses are optically scanned, and the resulting image is processed by a computer in order to select a ZIP code and associated postal destination from the typed address. Upon verifying that the ZIP code and postal destination are in agreement with each other, the automated system marks letters and postcards with fluorescent ink in a bar code format. The bar code is subsequently used by sorting equipment to route the mail into the proper destination bins.

The automated sorting equipment described above has several disadvantages. First, such systems require that the address be typed upon the letter or postcard. However, many postal system users do not own a typewriter, nor can they afford to purchase one. In addition, those postal system users who do own a typewriter would find it inconvenient to carry the typewriter along with them in order to write letters while away from the home or office. Secondly, such optical scanning equipment is very expensive and is subject to errors due to lack of uniformity in the format of the typed addresses. Errors may also be caused by smudged characters or the presence of foreign matter upon the letter in the vicinity of the typed address.

Magnetic ink has been widely used on bank checks to allow high speed machine processing of such checks. It is anticipated that magnetic ink may be used in the future for addressing mail to permit similar high speed machine processing of the mail.

Irregardless of whether postal services standardize upon optical scanning of addresses formed with conventional ink or machine reading of addresses formed with magnetic or other special ink, it is clear that address information should be in a standardized format in order to increase the efficiency of the automated sorting equipment.

A stamping device for impressing ZIP codes upon envelopes and the like is disclosed in U.S. Pat. No. 3,370,531. The device disclosed by the above mentioned United States patent includes a plurality of pinion wheels having cog gear teeth and a corresponding plurality of rack bars engaging the cog gear teeth for selecting the ZIP code to be printed. A pair of ink pads are disposed on opposite sides of the pinion wheels for inking the numerals carried thereon when the pinion wheels are rotated in either direction. Although the pinion wheels of the device disclosed by the above mentioned United States patent are shown having eleven cog gear teeth for printing the numerals 0–9, the disclosure states that twenty-seven such teeth may be used where the English alphabet is being imprinted.

Although the above mentioned prior art ZIP code stamper allows a ZIP code to be printed in a standardized format, it suffers from several disadvantages. First, the use of ink pads for inking the raised type characters on the pinion wheels results in printed characters of inconsistent density and clarity. An excess of ink deposited upon the raised type characters may cause the printed character to become blurred or smudged. On the other hand, when the pinion wheels are not rotated between successive printings, as would be true when the same or similar ZIP codes are being printed on several letters in succession, the raised type characters on the pinion wheels eventually lack sufficient ink to clearly print the selected character. In addition, the ink pads must be removed and replaced whenever a user desires to replenish the ink supply or to change the type of ink being used. The requisite handling of the ink pads at such times is necessarily a messy and time-consuming chore.

Another disadvantage of the prior art ZIP code stamper described above regards the difficulty which is encountered in modifying the printing mechanism to provide the letters of the English alphabet. If the number of cog gear teeth on a pinion wheel were increased from eleven to twenty-seven, the circumference of the pinion wheel, and correspondingly its diameter, would increase by a factor of 2.5. Similarly, the rack bar used to turn the pinion wheel would also be lengthened by a factor of 2.5. Thus, the overall dimensions of the prior art ZIP code stamper would be greatly increased, whereby the ZIP code stamper would become bulky and inconvenient to use. This consideration is particularly significant in view of a proposal by the United States Postal Service to adapt a nine-character ZIP code to more completely specify the address of the sender wherein the nine-character format may include alphabetical characters as well as numerals.

Another feature of the prior art ZIP code stamper which may be considered disadvantageous is the use of rack bars for selecting the characters to be printed. Many potential users of such a ZIP code stamper would prefer a means for selecting the characters to be printed which the user can manipulate with a single finger or thumb. Ideally, such a ZIP code stamper would also accommodate use by the blind.

To ensure a high degree of print quality, a ZIP code printer should be provided with a means for holding or clamping the letter or other article to be imprinted to prevent any movement of the letter or article during the printing process. Ideally, the article to be imprinted would be clamped only during the actual printing process in order to avoid interfering with insertion and withdrawal of the article to be imprinted from the ZIP code printer.

Accordingly, it is an object of the present invention to provide a printer adapted for printing ZIP codes in a standardized format wherein the printer is compact, convenient to use, and inexpensive.

It is another object of the present invention to provide a printer adapted for printing ZIP codes wherein the need for withdrawing and replacing ink pads is eliminated.

It is another object of the present invention to provide a printer adapted for printing ZIP codes wherein the printed characters have a sharpness and density of that customarily obtained only by using an inked ribbon.

Another object of the present invention is to provide a printer adapted for printing ZIP codes wherein the printing ink can be replenished or changed quickly and conveniently.

Still another object of the present invention is to provide a printer adapted for printing ZIP codes wherein both numerical and alphabetical characters may be printed while maintaining the printer as a compact unit.

It is another object of the present invention to provide a printer adapted for printing ZIP codes wherein a user can manipulate the means for selecting the characters to be printed with a single finger or thumb.

It is a further object of the present invention to provide a printer adapted for printing ZIP codes which can be used by people who are blind.

It is a still further object of the present invention to provide a printer adapted for printing ZIP codes which securely clamps the article to be imprinted during the printing process without interfering with the insertion of the article into the printer or the withdrawal of the article from the printer.

SUMMARY OF THE INVENTION

Briefly, and in accordance with one embodiment thereof, the present invention is a printer suitable for imprinting ZIP codes on letters and other articles, the printer including a printing head and an inked ribbon positioned between the printing head and the article to be imprinted. The printing head is mounted to a printing lever which, when fully depressed, forces the printing head and inked ribbon into intimate contact with the article to be imprinted. The inked ribbon is supported by a clamping member pivotally connected at one end to the printing lever. The clamping member has an aperture or window opposite the printing head, and the inked ribbon extends between the aperture and the printing head. A spring biases the printing lever away from the clamping member. The printer also includes a base pivotally connected to the clamping member, and a second spring biases the clamping member away from the base. The article to be imprinted is inserted between the base and the clamping member. Upon depression of the printing lever, the clamping member is initially forced toward the base member for clamping the article to be imprinted; upon further depression of the printing lever, the printing head and inked ribbon are extended through the aperture of the clamping member in order to print selected characters upon the inserted article. The clamping member also supports removable cartridges for dispensing and receiving the inked ribbon. A ribbon advance mechanism is operatively coupled between the printing lever and clamping member for advancing the inked ribbon each time the printing lever is depressed and released.

In cases where a relatively small number of different characters must be printed, the printing head includes a a printing wheel having raised type characters formed thereon and a reading wheel geared to the printing wheel in order to select the character to be printed. In cases where a relatively large number of different characters (e.g., the letters of the alphabet) must be printed, the printing head includes a printing tape upon which raised type characters are formed and first and second printing tape wheels around which the printing tape is rotatably supported. The printing head further includes a corresponding reading tape and first and second reading tape wheels around which the reading tape is rotatably supported. The reading tape and printing tape are synchronized by gears whereby a user rotates the reading tape in order to select the desired character on the printing tape into position for printing.

DESCRIPTION OF THE PREFERRED EMBODIMENT

Figure 1:
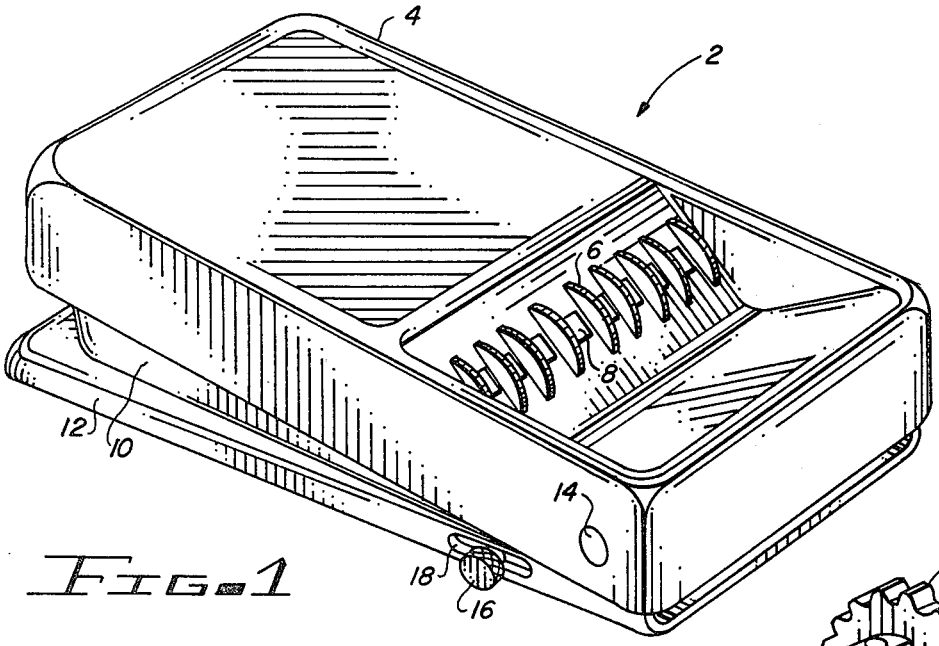
FIG. 1 is a perspective view of a printer suitable for printing a nine-character ZIP code.
Figure 6:
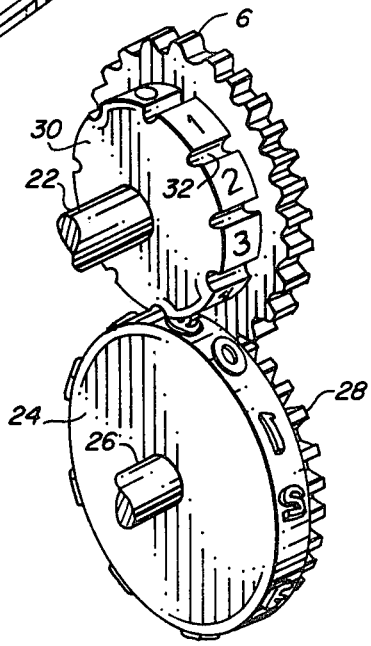
FIG. 6 is a detailed perspective view of a reading wheel and a printing wheel.

FIG. 1 illustrates a printer suitable for printing a nine-character ZIP code upon a letter, postcard or other article. The ZIP code printer is designated generally at 2 and includes a printing lever 4 for actuating the printing mechanism. The upper surface of printing lever 4 exposes nine thumb wheels of which thumb wheel 6 is representative. The thumb wheels are rotated by a user in order to select the desired characters for printing. As is shown more clearly in FIG. 2, a display window adjacent each thumb wheel allows the user to read the character which is presently selected in each printing position. For example, display window 8 displays the character presently selected by thumb wheel 6. The circumference of thumb wheel 6 forms a geared surface, as is shown in FIG. 6, which allows for convenient manipulation of the thumb wheels by a user.

ZIP code printer 2 also includes a clamping member 10 positioned below printing lever 4. Clamping member 10 also serves as a support for an inked ribbon as will be explained below. ZIP code printer 2 also includes a base 12 positioned below clamping member 10. Printing lever 4, clamping member 10, and base 12 are pivotally connected to each other at the rear portion of the printer by pins 14 on each side of printer 2. A letter or other article to be imprinted is inserted from the open or front portion of the printer between clamping member 10 and base 12.

In order to maximize the efficiency of automated mail sorting equipment, it is desirable to print the ZIP code a predetermined distance from the bottom edge of the letter or postcard. It is envisioned that letters being processed by the automated sorting equipment will be routed along high speed conveyors past a ZIP code reading station, the letters being oriented in an upright position and standing upon their bottom edges. The ZIP code reading equipment will be positioned the predetermined distance above the level of the conveyor in order to read the imprinted ZIP code. In order to adjust the position of the imprinted ZIP code relative to the bottom edge of the letter, an adjustable stop mechanism is included within ZIP code printer 2. A knurled thumb screw 16 is positioned within a slot 18 for adjusting a stop which limits inward movement of the letter relative to the printer as will be explained in more detail below.

Figure 2:
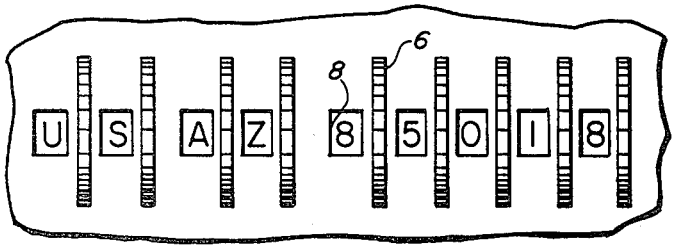
FIG. 2 is a more detailed view of the character selection and display portion of the printer.

The thumb wheel and display window portion of the printer illustrated in FIG. 2 shows a ZIP code format which may be adopted by the United States Postal Service. As shown, the new format may include both alphabetical characters and numerals. In the example illustrated, the printer has been selected to print a ZIP code corresponding to UNITED STATES, ARIZONA, AREA 84018. The automated ZIP code reading equipment will compare the alphabetical information with the numerical information to ensure that the ZIP code has been read properly.

Figure 3:
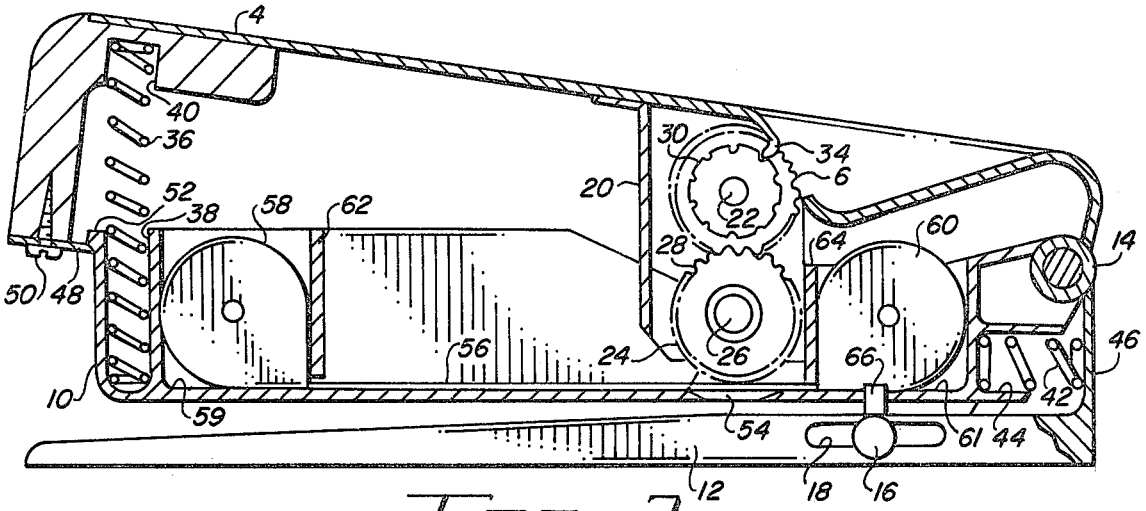
FIG. 3 is a cross-sectional side view of the printer taken through a printing wheel and a reading wheel.

In FIG. 3, the ZIP code printer is shown in cross-section through one of the printing positions which is required to print only the numerals 0–9. A printing head enclosure 20 is attached to printing lever 4. Thumb wheel 6 protrudes through the upper surface of printing lever 4 to permit rotation by the user. Thumb wheel 6 rotates about an axle 22 connected to printing head enclosure 20. Printing wheel 24 is positioned below thumb wheel 6 and rotates about an axle 26. Printing wheel 24 includes raised type numerals 0–9 formed upon its circumference. Printing wheel 24 protrudes through the lower portion of printing head enclosure 20.

A pinion 28 is integral with printing wheel 24 and meshes with the geared surface of thumb wheel 6 whereby rotation of thumb wheel 6 effects rotation of printing wheel 24. A reading wheel 30 is integral with thumb wheel 6, and its circumference is labeled with the numerals 0–9. Reading wheel 30 is positioned adjacent display window 8 for displaying the character on printing wheel 24 which is currently selected for printing. The circumference of reading wheel 30 is notched or indented between each of the labeled numerals, one such identation being designated 32 in FIG. 6. A detent spring 34 is positioned adjacent reading wheel 30 for engaging the indentations within the reading wheel, thereby retaining reading wheel 30 and printing wheel 24 in the proper position for printing the selected character.

A biasing spring 36 is positioned within guide channel 38 in the front portion of clamping member 10 and is also positioned within guide channel 40 in the front portion of printing lever 4. Biasing spring 36 exerts a force opposing movement of printing lever 4 toward clamping member 10. A second biasing spring 42 is positioned within guide channel 44 in the rear portion of clamping member 10. Biasing spring 42 engages rear wall 46 of base 12 and exerts a force opposing movement of clamping member 10 toward base 12. A tab 48 is secured by screw 50 to the frontmost portion of printing lever 4. When printing lever 4 is not depressed, biasing spring 36 raises printing lever 4 until tab 48 engages lipped edge 52 of clamping member 10. Upon rotation of tab 48, printing lever 4 may be raised away from clamping member 10 for providing access to the inner portions of clamping member 10, as for replacing or changing inked ribbons as explained below.

Clamping member 10 includes an aperture or printing window 54 opposite printing wheel 24. An inked ribbon 56 is supported upon the inner bottom surface of clamping member 10 and extends above aperture 54. A dispensing cartridge 58 is supported by portion 59 of clamping member 10 and dispenses inked ribbon 56. Similarly, a receiving cartridge 60 is supported by portion 61 of clamping member 10 and receives used portions of inked ribbon 56. Support walls 62 and 64 of clamping member 10 engage flattened surfaces of dispensing cartridge 58 and receiving cartridge 60, respectively, for maintaining the inked ribbon cartridges in proper position.

Figure 8:
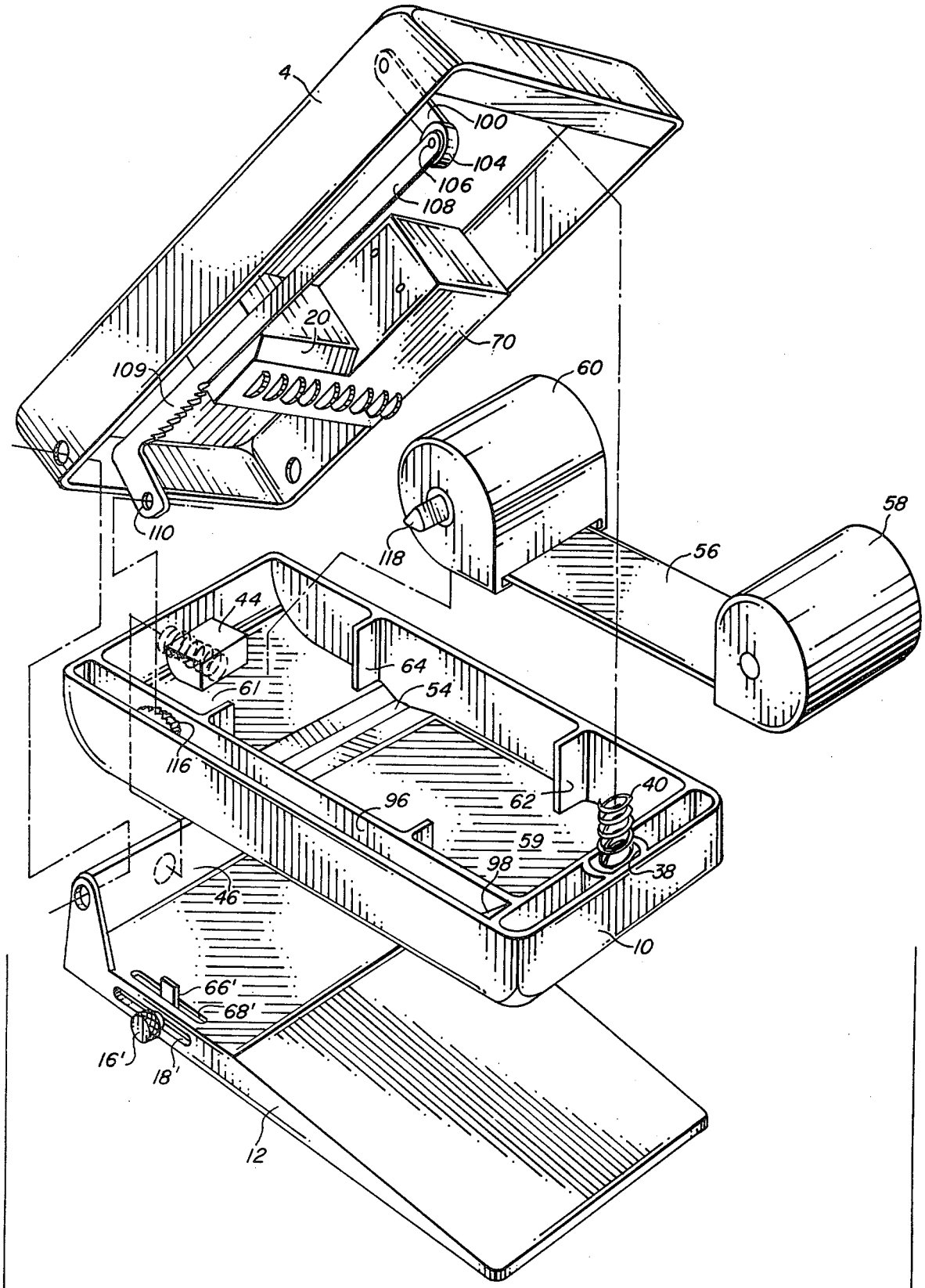
FIG. 8 is an exploded view of the printer including dispensing and receiving cartridges for an inked ribbon.

Also shown in FIG. 3 and more clearly in FIG. 8 is an adjustable stop mechanism for adjusting the distance from the bottom edge of a letter to the location at which the ZIP code is imprinted. Identical stop mechanisms are positioned on each side of base 12, primed reference numerals distinguishing one side from the other. A stop bar 66 is slidably positioned within a slot 68 on the upper surface of base 12. A corresponding slot 18 extends along the side of base 12, and knurled thumb screw 16 is slidably positioned within slot 18 for threadedly engaging stop bar 66. To adjust the printing location upon an envelope, stop bar 66 is positioned at a desired location whereupon thumb screw 16 is tightened against the side of base 12 to lock stop bar 66 at the desired location.

Figure 4:
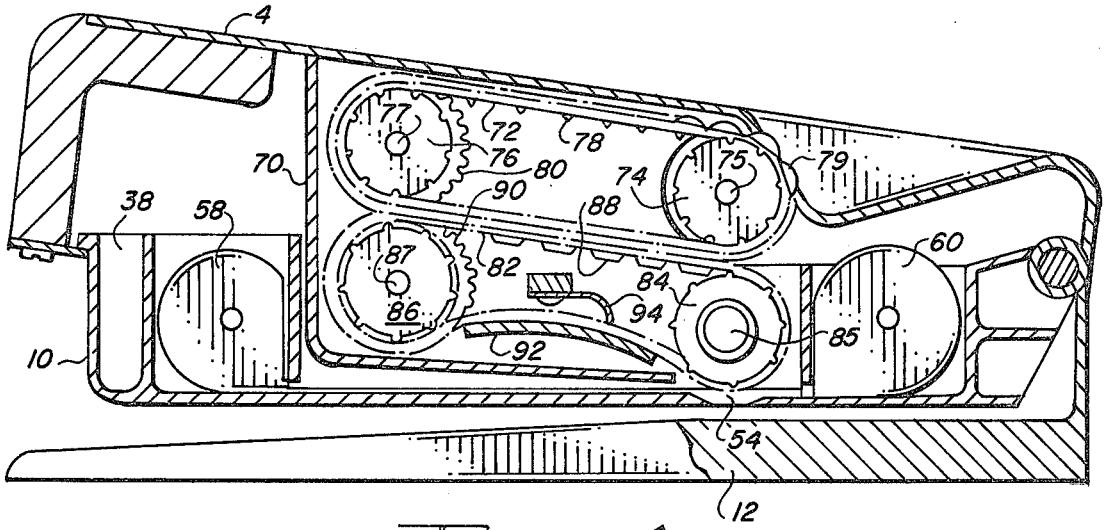
FIG. 4 is a cross-sectional view of the printer taken through a printing tape and reading tape.

FIG. 4 illustrates a printing tape and reading tape arrangement used in association with printing positions at which a relatively large number of characters, for example the letters of the alphabet, must be printed. A printing head enclosure 70 is attached to printing lever 4. Reading tape 72 extends around reading tape wheels 74 and 76. Reading tape wheels 74 and 76 rotate about axles 75 and 77, respectively, which are connected to printing head enclosure 70. Reading tape wheels 74 and 76 each has notches or indentations on its circumference similar to those described above with respect to reading wheel 30. The inner surface of reading tape 72 includes teeth-like protrusions, of which 78 is representative, which engage the indentations in reading wheels 74 and 76.

Although not illustrated, longitudinal grooves may also be formed upon the circumference of reading tape wheels 74 and 76 to engage longitudinal teeth formed upon the inner surface of reading tape 72 in order to prevent the reading tape from slipping sideways off of the reading tape wheels.

Integral with reading tape wheel 74 is a thumb wheel 79, similar to thumb wheel 6 described above, for rotating reading tape wheel 74 and reading tape 72 in conjunction therewith. Alternatively, reading tape 72 may include protrusions upon its outer surface for direct manipulation by the user, in which case thumb wheel 79 would be omitted. In either case, the outer surface of reading tape 72 includes labels for each of the characters to be printed. Reading tape wheel 74 is disposed adjacent one of the display windows in printing lever 4 for displaying the selected character. Integral with reading tape wheel 76 is an oversize gear 80.

A printing tape 82 extends between printing tape wheels 84 and 86. Printing tape wheels 84 and 86 each rotate about axles 85 and 87, respectively, which are connected to printing head enclosure 70. Printing tape 82 includes a series of cogs, of which 88 is representative, on its inner surface which are engaged by teeth formed on the circumference of printing tape wheels 84 and 86. Although not illustrated, a longitudinal groove may be formed upon the circumference of printing tape wheels 84 and 86 to engage longitudinal teeth formed on cogs 88 in order to prevent the printing tape from slipping sideways off of the printing tape wheels.

A gear 90 is integral with printing tape wheel 86 and meshes with gear 80 whereby rotation of reading tape 72 causes synchronized rotation of printing tape 82. The outer surface of printing tape 82 has a plurality of raised type characters formed thereupon. Printing tape wheel 84 is disposed adjacent aperture 54 in clamping member 10 for printing the selected character. A wiper 92 abuts the outer surface of printing tape 82 for cleaning the printing tape. A detent spring is positioned opposite wiper 92 and adjacent the inner surface of printing tape 82. Detent spring 94 engages printing tape 82 between cogs 88 for holding printing tape 82 in the proper position for printing.

Reading tape 72 and printing tape 82 may each be made from a suitable plastic material and injection molded in one piece. The raised type characters on the outer surface of printing tape 82 could be hardened with a metallic coating similar to the process used for hardening ball-style typewriter typing elements.

Figure 5:
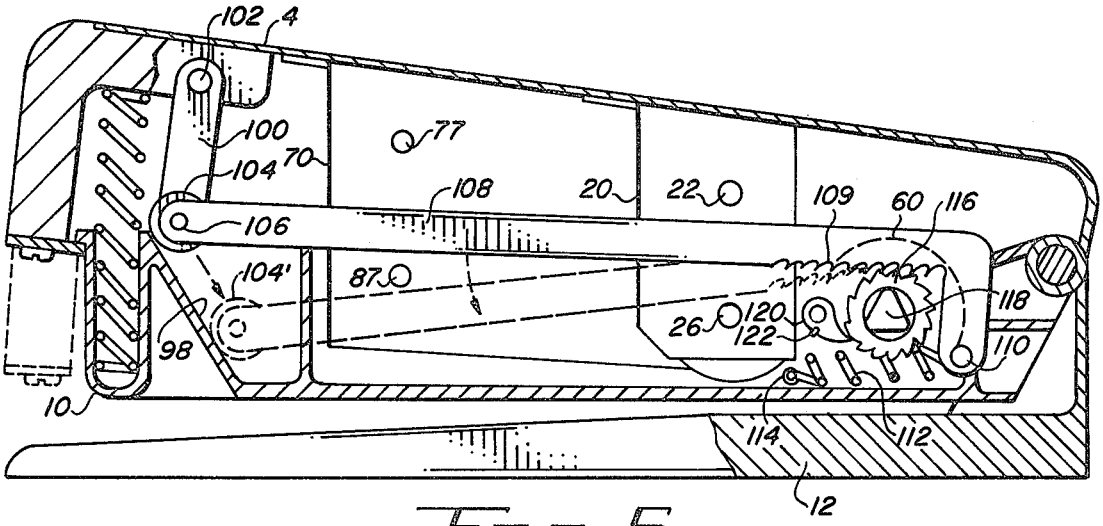
FIG. 5 is a cross-sectional view of the printer taken through the ribbon advance mechanism.

FIG. 5 illustrates a ribbon advance mechanism which advances a fresh portion of inked ribbon 56 over aperture 54 each time printing lever 4 is depressed and released. The ribbon advance mechanism is positioned within chamber 96 of clamping member 10 as shown in FIG. 8. Chamber 96 includes an inclined surface 98 which slopes downward and toward the rear of the printer. Link 100 has its upper end pivotally attached to printing lever 4 by pin 102. The lower end of link 100 is pivotally connected to a roller-follower 104 by an axle 106. The rear end of rack bar 108 includes a toothed surface 109 and a hole 110. A retractor spring 112 has one of its end in engagement with hole 110 and the other of its ends in engagement with a hole 114 in clamping member 10. Retractor spring 112 exerts a forward and slightly downward directed force on rack bar 108.

A ratchet gear 116 is rotatably mounted adjacent toothed surface 109 of rack bar 108. The interior of ratchet gear 116 has a triangular shaped chamber for engaging triangular spline 118 on inked ribbon receiving cartridge 60. A pawl is positioned adjacent ratchet gear 116 for preventing rotation of ratchet gear 116 upon rearward movement of rack bar 108. A spring 122 biases pawl 120 against ratchet gear 116.

Operation:

During actual use of the disclosed printer, a user rotates the thumb wheels protruding through the upper surface of printing lever 4 until each of the desired characters appears in the display windows. A letter or other article to be imprinted is inserted between clamping member 10 and base 12 until its lower edge contacts stop bars 66 and 66'. The user then depresses printing lever 4 whereupon biasing spring 42 is compressed and clamping member 10 securely clamps the letter against base 12. Printing lever 4 and clamping member 10 initially move downward together as a unit because biasing spring 42 is much weaker than biasing spring 36. After the letter is clamped between clamping member 10 and base 12, further depression of printing lever 4 causes printing wheel 24 and/or printing tape wheel 84 to advance toward the inked ribbon 56 and aperture 54. When printing lever 4 is fully depressed, the selected raised type characters and inked ribbon extend through aperture 54 and intimately contact the letter being imprinted.

As printing lever 4 is depressed, roller-follower 104 of the ribbon advance mechanism rolls down inclined surface 98 causing rearward movement of rack bar 108. The toothed surface 109 of rack bar 108 slides across ratchet gear 116 which remains fixed due to pawl 120.

Upon release of printing lever 4, the printing wheels and/or printing tape wheels move away from aperture 54; subsequently, clamping member 10 rises away from base 12, releasing the printed letter. As printing lever 4 moves away from clamping member 10 under the force of biasing spring 36, link 100 rises. Retractor spring 112 pulls rack bar 108 forward, and roller-follower 104 rolls back up inclined surface 98. As rack bar 108 moves forward, the toothed surface 109 engages the teeth of ratchet gear 116 and causes it to rotate. Consequently, triangular spline of receiving cartridge 60 is also rotated whereby a fresh portion of inked ribbon is withdrawn from dispensing cartridge 58.

Whenever it is desired to replenish an exhausted ribbon cartridge or to change the type of ink, the user rotates tab 48 on printing lever 4 away from lipped edge 52 on clamping member 10 to access the inner portion of clamping member 10. Ribbon cartridges 58 and 60 may then be conveniently withdrawn and replaced with similar cartridges. Inked ribbon 56 may contain conventional printing ink or special types of ink such as magnetic ink.

To accommodate use by the blind, reading wheel 30 and reading tape 72 include raised characters in Braille format which a user can sense through the printing lever display windows in order to verify that the desired characters have been selected.

Figure 7:
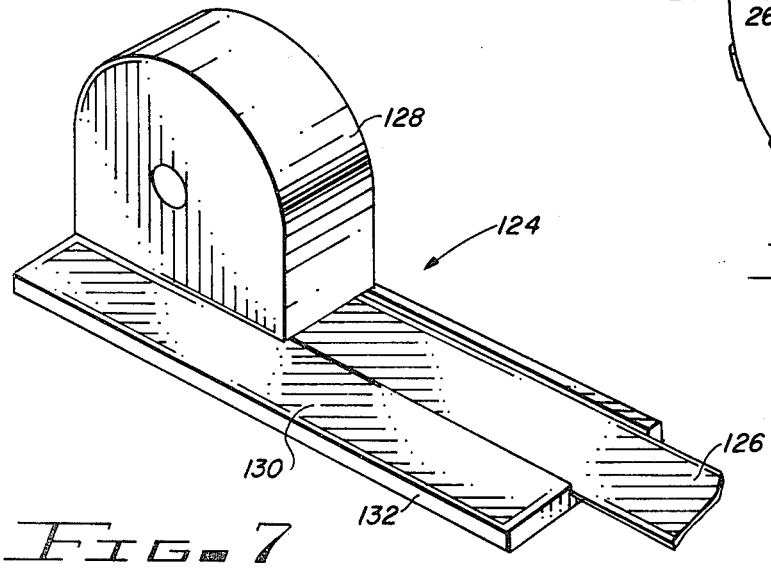
FIG. 7 illustrates an adhesive-backed label dispenser which may be used in conjunction with the disclosed printer for applying printed ZIP codes to parcels and other bulky articles.

To apply ZIP code information to parcels or other articles which can not be inserted into the printer, a label dispenser like that shown as 124 in FIG. 7 may be used in conjunction with the printer. A roll of adhesive-backed printing labels are stored within a reel housing 128 of dispenser 124. Reel housing 128 is mounted upon a base 130 which is inserted between clamping member 10 and base 12 of the printer. Bottom edge 132 can be rested against stop bars 66 and 66' to align printing label 126 with aperture 54. The printed label is then applied to the parcel.

It will now be appreciated that a compact and inexpensive printer has been described which is ideally suited to print machine readable characters upon an article. While the invention has been described with reference to a preferred embodiment thereof, the description is for illustrative purposes only and is not to be construed as limiting the scope of the invention. A printer of the type herein disclosed may easily be adapted to print information other than ZIP codes. For example, the disclosed printer could be modified to print characters (such as the amount of the check) upon bank checks using magnetic ink. Various modifications and changes may be made by those skilled in the art without departing from the true spirit and scope of the invention as defined by the appended claims.

We claim:

1. A printer for imprinting inked characters upon an article, said printer comprising:

a. a base member having front and rear portions;

b. a clamping member overlying said base member and having front and rear portions, said clamping member having an aperture therein and including an inclined surface sloping toward the rear portion of said clamping member;

c. a printing lever overlying said clamping member and having front and rear portions;

d. pivot means for pivotally connecting the rear portions of said base member, said clamping member and said printing lever to each other;

e. a printing head mounted upon said printing lever adjacent the aperture in said clamping member, said printing head selectively providing raised type characters for imprinting the article;

f. an inked ribbon positioned between said printing head and the aperture in said clamping member;

g. first biasing means connected to said printing lever and to said clamping member for exerting a biasing force which biases said printing head away from the aperture in said clamping member;

h. second biasing means connected to said base member and to said clamping member for exerting a biasing force which biases the front portion of said clamping member away from the front portion of said base member, the biasing force exerted by said second biasing means being lesser than the biasing force exerted by said first biasing means;

i. depression of said printing lever toward said base member causing an article inserted between said base member and said clamping member to be clamped between said base member and said clamping member prior to passage of said raised type characters and said inked ribbon through the aperture in said clamping member for imprinting inked characters upon the article;

j. dispensing means supported by said clamping member on one side of the aperture for dispensing said inked ribbon;

k. receiving means supported by said clamping member on an opposite side of the aperture for receiving said inked ribbon, said receiving means including a shaft upon which said inked ribbon is wound; and l. ribbon advance means coupled to said printing lever and to said clamping member and engaging said receiving means, said ribbon advance means causing a portion of said inked ribbon to be received by said receiving means each time said printing lever is actuated for positioning a fresh portion of said inked ribbon between said printing head and the aperture in said clamping member, said ribbon advance means comprising:

i. a link having two ends and pivotally connected at one of its ends to said printing lever;

ii. a roller-follower rotatably mounted to said link at the other of its ends, said roller-follower abutting the inclined surface of said clamping member for rolling engagement therewith when said printing lever is depressed;

iii. a rack bar pivotally connected to said roller-follower, said rack bar having a longitudinal axis and having a toothed surface;

iv. ratchet gear means mounted to said clamping member adjacent said rack bar and engaged with the toothed surface thereof, said ratchet gear means remaining fixed against rotation upon movement of said rack bar in a first direction along its longitudinal axis and being rotated upon movement of said rack bar along its longitudinal axis in a second direction opposite to said first direction, said ratchet gear means engaging the shaft of said receiving means for rotating the shaft upon reciprocal movement of said rack bar along its longitudinal axis and thereby causing a fresh portion of said inked ribbon to be positioned between said printing head and the aperture in said clamping member; and v. third biasing means connected to said rack bar for biasing said rack bar toward the front portion of said clamping member;

whereby, upon depression of said printing lever, said roller-follower travels along the inclined surface of said clamping member causing said rack bar to move toward the rear portion of said clamping member and, upon release of said printing lever, said third biasing means biases said rack bar toward the front portion of said clamping member for rotating said ratchet gear means.

2. A printer as recited in claim 1 wherein said dispensing means and said receiving means each comprise a removable cartridge.

3. A printer as recited in claim 1 wherein said printing head comprises:

a. a support mounted to said printing lever;

b. printing means rotatably mounted to a lower portion of said support for printing characters, said printing means having raised type characters formed thereupon, said printing means including a circular gear rotating therewith; and c. reading means rotatably mounted to an upper portion of said support for selecting the character to be printed by said printing means and for indicating to a user the selected character, said reading means including a circular gear rotating therewith, said circular gear of said printing means being meshed with said circular gear of said reading means for synchronizing said printing means with said reading means.

4. A printer as recited in claim 3 wherein:

a. said printing means includes a printing wheel, said circular gear of said printing means being a pinion integral with said printing wheel; and b. said reading means includes a reading wheel, said circular gear of said reading means being integral with said reading wheel and being meshed with said pinion.

5. A printer as recited in claim 3 wherein:

a. said printing means includes a printing tape having an outer surface, the outer surface having raised type characters formed thereupon, said printing means also including first and second printing tape wheels around which said printing tape is rotatably supported, said circular gear of said printing means being integral with one of said first and second printing tape wheels; and b. said reading means includes a reading tape and first and second reading tape wheels around which said reading tape is rotatably supported, said circular gear of said reading means being integral with one of said first and second reading tape wheels.

6. A printer for imprinting inked characters upon an article, said printer comprising:

a. a printing lever having front and rear portions;

b. printing means rotatably mounted to said printing lever for printing characters, said printing means having raised type characters formed thereupon, said printing means including a circular gear rotating therewith;

c. ribbon supporting means having front and rear portions, the rear portion of said ribbon supporting means being pivotally connected to the rear portion of said printing lever, said ribbon supporting means having an aperture adjacent said printing means and including an inclined surface sloping toward the rear portion of said ribbon supporting means;

d. an inked ribbon supported by said ribbon supporting means, said inked ribbon extending adjacent the aperture in said ribbon supporting means;

e. first biasing means coupled between said printing lever and said ribbon supporting means opposing movement of said printing means toward the aperture in said ribbon supporting means;

f. reading means rotatably mounted to said printing lever for selecting the character to be printed by said printing means and for indicating to a user the selected character, said reading means including a circular gear rotating therewith, said circular gear of said printing means being meshed with said circular gear of said reading means wherein rotation of said reading means by a user effects synchronized rotation of said printing means;

g. dispensing means supported by said ribbon supporting means on one side of the aperture for dispensing said inked ribbon;

h. receiving means supported by said ribbon supporting means on an opposite side of the aperture for receiving said inked ribbon, said receiving means including a shaft upon which said inked ribbon is wound; and i. ribbon advance means coupled to said printing lever and to said ribbon supporting means and engaging said receiving means, said ribbon advance means causing a portion of said inked ribbon to be received by said receiving means each time said printing lever is actuated for positioning a fresh portion of said inked ribbon between said printing means and the aperture in said ribbon supporting means, said ribbon advance means comprising:

i. a link having two ends and pivotally connected at one of its ends to said printing lever;

ii. a roller-follower rotatably mounted to said link at the other of its ends, said roller-follower abutting the inclined surface of said ribbon supporting means for rolling engagement therewith when said printing lever is depressed;

iii. a rack bar pivotally connected to said roller-follower, said rack bar having a longitudinal axis and having a toothed surface;

iv. ratchet gear means mounted to said ribbon supporting means adjacent said rack bar and engaged with the toothed surface thereof, said ratchet gear means remaining fixed against rotation upon movement of said rack bar in a first direction along its longitudinal axis and being rotated upon movement of said rack bar along its longitudinal axis in a second direction opposite to said first direction, said ratchet gear means engaging the shaft of said receiving means for rotating the shaft upon reciprocal movement of said rack bar along its longitudinal axis and thereby causing a fresh portion of said inked ribbon to be positioned between said printing means and the aperture in said ribbon supporting means; and v. second biasing means connected to said rack bar for biasing said rack bar toward the front portion of said ribbon supporting means;

whereby, upon depression of said printing lever, said roller-follower travels along the inclined surface of said ribbon supporting means causing said rack bar to move toward the rear portion of said ribbon supporting means and, upon release of said printing lever, said second biasing means biases said rack bar toward the front portion of said ribbon supporting means for rotating said ratchet gear means.

7. A printer as recited in claim 6 wherein:

a. said printing means includes a printing wheel, said circular gear of said printing means being a pinion integral with said printing wheel;

b. said reading means comprises a reading wheel, said circular gear of said reading means being integral with said reading wheel and being meshed with said pinion.

8. A printer as recited in claim 6 wherein:

a. said printing means includes a printing tape having raised type characters formed thereupon, said printing means also including first and second printing tape wheels around which said printing tape is rotatably supported, said circular gear of said printing means being integral with one of said first and second printing tape wheels; and b. said reading means includes a reading tape and first and second reading tape wheels around which said reading tape is rotatably supported, said circular gear of said reading means being integral with one of said first and second reading tape wheels.

9. A printer as recited in claim 6 wherein said dispensing means and said receiving means each comprise a removable cartridge.

* * * * *